United States Patent [19]

Rohner

[11] Patent Number: 4,571,928

[45] Date of Patent: Feb. 25, 1986

[54] SPLICING HEAD OPERATED BY COMPRESSED AIR

[75] Inventor: Joachim Rohner, Monchen-Gladbach, Fed. Rep. of Germany

[73] Assignee: W. Schlafhorst & Co., Monchen-Gladbach, Fed. Rep. of Germany

[21] Appl. No.: 599,174

[22] Filed: Apr. 11, 1984

[30] Foreign Application Priority Data

Apr. 13, 1983 [DE] Fed. Rep. of Germany ..... 3313323

[51] Int. Cl.[4] ..... B65H 69/06; D01H 15/00; D02J 1/08

[52] U.S. Cl. ..... 57/22; 57/261

[58] Field of Search ..... 57/22, 27, 261, 350, 57/202, 333; 28/271-276

[56] References Cited

U.S. PATENT DOCUMENTS 4,292,796 10/1981 Mima ..... 57/261 X 4,419,858 12/1983 Rohner et al. ..... 57/22

*Primary Examiner*—John Petrakes

*Attorney, Agent, or Firm*—Herbert L. Lerner; Laurence A. Greenberg

[57] ABSTRACT

Splicing head operated by a compressed gas for use in an automatic splicing device for producing by splicing a thread connection without knots, having a splicing head with at least two openings to admit the compressed gas, which accepts the two threads which are to be joined together, and has the capability to effect the mutual tangling, interwining, mixing and/or winding around of the fibers of the thread and which is provided at both ends of the splicing channel with thread- and air guides which cover the ends of the splicing channel asymmetrically so that only a part of the termination of the splicing channel remains free and which includes thread- and air guides connected with a removable cover which covers the splicing channel.

2 Claims, 4 Drawing Figures

SPLICING HEAD OPERATED BY COMPRESSED AIR

The invention relates to a splicing head operated by a compressed gas for use in an automatic splicing device to produce by splicing a thread connection without knots, having a splicing head with at least two openings to admit the compressed gas which accepts the two threads which are to be joined together ans has the capability to effect the mutual tangling, intertwining, mixing and/or winding-around of the fibers of the thread and which is provided at both ends of the splicing channel with thread- and air guides which cover the ends of the splicing channel asymmetrically so that only a part of the termination of the splicing channel remains free.

In a co-pending application Ser. No. 488,104, filed Apr. 25, 1983, now U.S. Pat. No. 4,468,918, of which the applicant is a co-inventor, there are shown more simple thread splicing devices by the arrangement that at both ends of the splicing channel thread-and air guides are provided which asymmetrically cover the ends of the splicing channel so that only a part of the termination of the splicing channel remains free. This arrangement created a universally applicable splicing head which can produce in an automatic thread splicing device stronger, better-looking and more durable splice connections than were produced previously.

However, since the thread-and air guides present an obstruction when the threads are inserted or removed from the splicing channel, the invention at hand has the basic objective to remove this obstacle, and to improve and accelerate thereby the thread joining operation. According to the invention this objective is achieved by the feature that the thread-and air guides are connected with a removable cover which covers the splicing channel, and which consists in particular of plates which are provided with thread guiding edges.

Now the insertion of the threads into the splicing channel of the splicing head is not obstructed anymore by the added thread-and air guides. To insert the threads into the splicing channel the cover with the thread-and air guides fastened to it is first removed from the splicing head, for example it can be hinged sideways. Thereby the splicing channel is completely exposed, and the insertion of the thread makes no difficulties. As the cover is hinged back the thread guiding edges direct the inserted threads into the position where they are supposed to be, for example, in the lower region of the splicing channel their sides adjacent to the inlet openings for the compressed gas.

The invention makes a splicing connection possible which as a rule has more strength and a better appearance as was possible before, already after the first splicing attempt and without repetitions. Also the quality of the splicing connection does not vary as much as before. The individual fibers are more intimately mixed and more uniformly intertwined, and stronger inter-connection of the fibers are achieved.

The removal of the finished thread connection from the splicing channel is also considerably facilitated by the invention.

The form and arrangement of the thread-and air guides determines the position of the threads at the ends of the splicing channel, and also defines the air flow during the splicing operation. For example, the thread-and air guides can provide that the threads are adjacent to each other in the splicing channel, in such a way that at least one compressed gas inlet lies to the left and another gas inlet terminates to the right of the adjacent threads in the splicing channel. The partial covering of the termination of the splicing channel prevents that the splicing air is discharged too rapidly from the splicing channel during the splicing operation.

A typical embodiment of the invention used as an example is shown in the drawings. The invention will described and explained in more detail with the aid of this embodiment.

Figure 1:
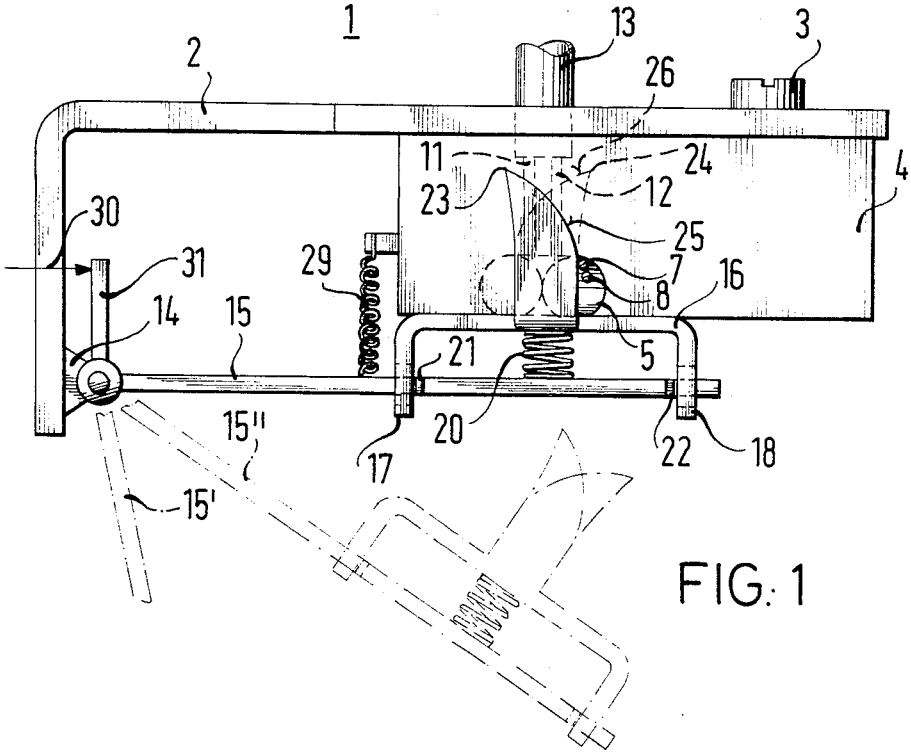
FIG. 1 shows a top view of the splicing head and cover.

The splicing device as a whole designated with 1 has a basic body 2 to which a pressurized gas splicing head 4 is fastened by a screw 3. The pressurized gas splicing head 4 has the shape of a block, is of compact design and made of metal. It is provided with an obliquely disposed splicing channel 5 having an approximately circular cross section. In front the splicing channel 5 is open over its full length, and thereby forms an insertion gap 6 for the two threads 7, 8 which are to be spliced to each other.

The splicing channel 5 has two inlet openings 9, 10 for the compressed gas. The inlet opening 9 for the compressed gas lies at the end of a compressed gas channel 11, and the inlet opening 10 lies at the end of a compressed gas channel 12. During the splicing operation the two compressed gas channels 11 and 12 are supplied with compressed air through a line 13.

Figure 3:
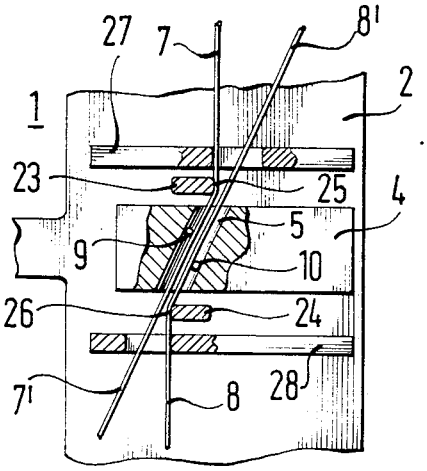
FIG. 3 shows a partial view of the splicing device partially cut open.

FIG. 3 shows that the two inlet openings 9 and 10 for the compressed gas terminate in the splicing channel 5 off-set and opposite to each other to the left and to the right of the inserted thread.

Their distance from each other corresponds approximately to the diameter of the splicing channel 5.

Figure 2:
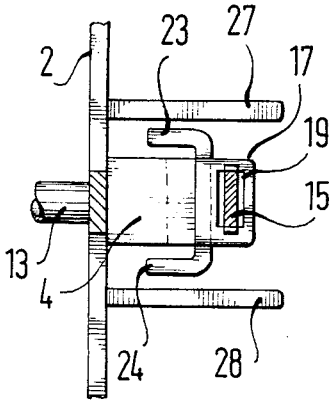
FIG. 2 shows the side view of the splicing head and cover in a smaller scale.

According to FIG. 1 the basic body 2 has a rotary (hinge) joint 14 for the holder arm 15 of a cover 16 which covers the splicing channel 5. The ends 17 and 18 of the cover 16 are bent up, and are provided with holes 19 (FIG. 2). The holes 19 serve for mounting the cover 16 onto the holder arm 15, and at the same time they allow a limited movability of the cover 16 with respect to the holder arm 15. A compression spring 20 is positioned between the cover 16 and the holder arm 15, and provides a springy yielding connection of the two parts. The position of the cover 16 on the holder arm 15 is secured by the stops 21 and 22.

The cover 16 is provided with two thread-and air guides 23 and 24. These thread-and air guides consist of plates which have thread guiding edges 25, 26, repectively. FIG. 1 shows that the thread guiding edges have an arc-like shape. FIG. 3 shows that the thread guiding edges are rounded off. The thread-and air guides are rigid parts of the cover 16. For this purpose the cover 16 is manufactured by a blanking and forming method. The cover is stamped from a flat plate together with its ends and with the thread-and air guides, and subsequently the two ends 17 and 18 are bent to one side, and the thread-and air guides 23 and 24 are bent to the other side.

The thread-and air guides 23 and 24 cover the terminations of the splicing channel 5 asymmetrically, so that only a part, approximately only one half of the two terminations of the splicing channel remains uncovered. FIG. 3 shows, that the two thread-and air guides 23 and 24 maintain a defined distance from the pressurized gas splicing head 4. This distance can be differently dimensioned from case to case.

Figure 4:
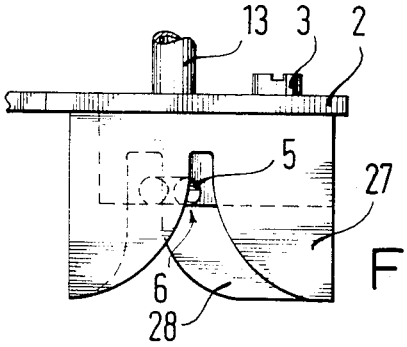
FIG. 4 shows the splicing device according to FIG. 3 seen from the top.

Above the thread-and air guide 23 the basic body 2 is provided with an insertion plate 27, and below the thread-and air guide 24 there is an insertion plate 28. Both insertion plates have thread guiding contours in the form of funnel-like notches, especially shown clearly in FIG. 4.

FIG. 1 shows that the cover 16 is held in the closed position by a spring element 29. The cover 16 lies elastically on the pressurized splicing head 4, and thereby seals the splicing channel 5 at the front. To open the cover 16, the automatic splicing apparatus (not shown here) of the splicing device 1 applies a force in direction of arrow 30 onto a lever 31 which is connected with the holder arm 15, whereby the holder arm 15 is moved to the open position 15'. In this position the threads which are to be joined 7 and 8 can be inserted into the splicing channel 5 guided by the insertion plates 27 and 28. Thereafter the force onto lever 31 is released, and the holder arm 15 swings by the action of spring element 29 from the open position 15', through an intermediate position 15'' into the closed position shown in FIG. 1. Thereby the two thread-and air guides 23 and 24 dip into the interspaces between the pressurized gas splicing head 4 and the insertion plate 27, 28, respectively, and thereby push the threads 7 and 8 into the required position, shown here in FIG. 3 and in FIG. 1. Now the splicing operation can be started by the supply of compressed air. After the splicing operation the thread ends 7' and 8' can be severed. The cutting and shortening to the thread ends can also be performed before the splicing operation. However, the means to do this are not shown in the drawings.

The invention is not limited to the illustrated and described typical embodiment used as an example.

We claim:

1. In an automatic splicing device, a splicing head operable by pressurized gas for producing a knotless thread connection by splicing, the splicing head being formed with at least two pressurized-gas openings for mutually entangling, interwining, intermixing and/or winding-around fibers of threads to be joined together which are receivable in a splicing channel formed in the splicing head, wherein the threads are spliced and having thread and air guides for guiding the respective threads and the pressurized gas at both terminating ends of the splicing channel for asymmetrically covering the terminating ends so that only part thereof remains open for passing the threads therethrough, comprising a cover for the splicing channel with which the thread and air guides are connected, and means for withdrawing said cover from the splicing channel.

2. Splicing head according to claim 1 wherein the thread and air guides are made up of plates connected to said cover and formed with respective thread guiding edges for guiding the threads into the splicing channel.

* * * * *